US005734728A

United States Patent [19]

Meissner

[11] Patent Number: 5,734,728

[45] Date of Patent: Mar. 31, 1998

[54] PORTABLE SOUND SPEAKER SYSTEM AND DRIVING CIRCUIT THEREFOR

[76] Inventor: Juergen P. Meissner, 551 Rte. 10, Randolph, N.J. 07869

[21] Appl. No.: 346,754

[22] Filed: Nov. 30, 1994

[51] Int. Cl.[6] ..... H04R 1/02

[52] U.S. Cl. ..... 381/89; 381/159; 381/160; 381/154; 181/148; 181/153; 181/155; 181/156; 330/105; 330/129; 330/279

[58] Field of Search ..... 381/89, 159, 160, 381/154; 181/148, 153, 199, 155, 156; 330/279, 129, 105

[56] References Cited

U.S. PATENT DOCUMENTS

| | | | |
|---|---|---|---|
| 2,228,886 | 1/1941 | Olson . | |
| 2,896,737 | 7/1959 | Gellman . | |
| 2,993,091 | 7/1961 | Guss . | |
| 3,393,766 | 7/1968 | Mitchell . | |
| 3,750,838 | 8/1973 | Pyle, Jr. . | |
| 3,945,461 | 3/1976 | Robinson . | |
| 3,978,941 | 9/1976 | Siebert . | |
| 4,146,110 | 3/1979 | Maloney et al. | 181/147 |
| 4,270,023 | 5/1981 | Beveridge . | |
| 4,497,064 | 1/1985 | Polk . | |
| 4,580,654 | 4/1986 | Hale . | |
| 4,616,731 | 10/1986 | Robinson . | |
| 4,628,528 | 12/1986 | Bose et al. . | |
| 4,930,596 | 6/1990 | Saiki et al. . | |
| 4,995,113 | 2/1991 | Robineau et al. . | |
| 5,010,977 | 4/1991 | Furukawa et al. . | |
| 5,097,513 | 3/1992 | Jordan et al. . | |
| 5,111,509 | 5/1992 | Takeuchi et al. . | |
| 5,173,575 | 12/1992 | Furukawa . | |

OTHER PUBLICATIONS

"Bose, Professional Wave Systems", date unknown.

*Primary Examiner*—Curtis Kuntz
*Assistant Examiner*—Duc Nguyen
*Attorney, Agent, or Firm*—Richard M. Goldberg

[57] ABSTRACT

A speaker system includes a vertically oriented elongated tube supported on a ground surface, and open at upper and lower ends thereof; a woofer, mid-range speaker and tweeter mounted at a lower end of the tube, the woofer having a front driving face with an effective driving area, the woofer providing an in-phase audio signal directed upwardly through the tube and an out-of-phase ground wave audio signal directed in an opposite direction therefrom; an enclosure enclosing the woofer and mounting the tube on the ground surface; a restricted open area formed between a lower edge of the enclosure and the ground surface and being less than the effective driving area, the restricted open area being arranged to transmit the out-of-phase ground wave audio signal from the woofer in a direction transverse to the axial direction; and a driving circuit for driving the woofer and including a power amplifier for amplifying an input signal with a variable gain and supplying the amplified input signal to the woofer, a circuit for measuring the impedance of the woofer, including a resistor monitoring a current of the amplified input signal supplied to the speaker, and a circuit for varying the gain of the first power amplifier in dependence upon the measured impedance of the woofer, so as to increase the gain of the power amplifier primarily for low frequency components of the input signal in response to the monitored current by the resistor.

27 Claims, 6 Drawing Sheets

PORTABLE SOUND SPEAKER SYSTEM AND DRIVING CIRCUIT THEREFOR

BACKGROUND OF THE INVENTION

The present invention relates generally to speaker systems for use in stereo systems, and more particularly, is directed to a vertically oriented, tubular speaker system.

Conventional speaker systems include at least one speaker, such as a woofer, mid-range speaker and tweeter, all of which project sound forwardly in a single direction. A problem with such speaker systems is that the level of the sound drops off rather quickly in the aiming direction, and drops off even faster in other directions. As a result, there is non-uniformity of sound level in a room. Still further, the sound quality of such speaker systems is often less than desirable, and therefore, complex and expensive circuitry must be added to increase the quality of the different frequency sounds.

Other speaker systems are known which use a vertically oriented tube with a speaker therein.

For example, U.S. Pat. No. 2,896,737 to Gellman discloses an extension loud speaker that can be mounted vertically on a wall, with the tubular enclosure thereof being open at both ends thereof. However, there is no effective loading from the rear of such loud speaker. Accordingly, the sound quality is relatively poor. In addition, because the loud speaker is mounted on a wall, any back wave from the bottom of the tube will travel from the bottom thereof along the nearest surface, which is the tube itself of the adjacent wall. Therefore, the back wave will tend to cancel somewhat with the front wave from the top of the tube, thereby further reducing the quality of sound from the loud speaker. In particular, the low frequency sound wave from the bottom of the tube will cancel with the low frequency portion of the sound wave from the top of the tube, so that there will effectively be no low frequency output below approximately 300 Hz.

U.S. Pat. No. 3,750,838 to Pyle, Jr. discloses a concrete resonant cone speaker system which utilizes an elongated tube with an upward facing speaker mounted at the lower end thereof. However, such a system is a resonant system, that is, the patent specifically states that the system includes a concrete resonant cone speaker system and that the hollow tile of the cone may contain a tuned resonant column of air. This is disadvantageous for stereo speakers where resonance is to be avoided at all costs. Further, in Pyle, Jr., the entire bottom is spaced sufficiently above the floor so as to isolate the concrete cone, and as stated in patent, in much the same way as the tines on a tuning fork are isolated. In other words, this is necessary in order to obtain the resonance. This is in accordance with the effective use of the same as a resonant system. Still further, the entire area below the speaker is open, thereby providing no effective loading on the speaker. Therefore, because there is almost no loading on the speaker, and because the speaker is spaced a relatively large distance from the floor or ground, the rear wave from the speaker will travel up the speaker cone, and cancel somewhat with the wave from the top of the speaker cone. Thus, the frequency response of such a system at low frequencies is very poor.

U.S. Pat. No. 3,945,461 to Robinson discloses a sound speaker system having an elongated vertical cylinder open at its upper and lower ends, and seated on a base stand having legs to provide air flow. The speaker is primarily facing down at the bottom of a vertical tube, although the patent provides an alternate arrangement in which the speaker is facing upwardly. However, because of the fact that the speaker is spaced far off of the floor or ground and because there is no enclosure at the bottom or rear of the speaker, there is no effective resistive loading on the speaker from the rear thereof, and in addition, the rear wave will travel up the elongated tube to cancel with the forward wave from the top of the tube.

U.S. Pat. No. 4,616,731 to Robinson discloses a speaker system having a long vertical tube with a speaker at the bottom thereof and facing upwardly into the tube. However, in view of the holes along the length of the tube and the adjacent tubes connected therewith, this speaker system functions as a sound resonator chamber, which is undesirable in high fidelity stereo systems.

In U.S. Pat. No. 5,111,509, different tubes are provided which are tuned to a particular resonant frequency, much like a pipe organ. Therefore, this arrangement could not be used for reproduction of sound in a high fidelity stereo system.

Other patents are known which provide a speaker at the upper end of an elongated vertical tube. See, for example, U.S. Pat. No. 3,978,941 to Siebert and U.S. Pat. No. 4,580,654 to Hale. However, there is effectively no load on the front face of the speaker, so that the sound dissipates very rapidly, and therefore, no high quality sound is produced.

Still further, other tube speakers are known which are oriented horizontally. However, such tube speakers set up a unidirectional wave similar to conventional speakers. See, for example, U.S. Pat. No. 3,393,766 to Mitchell and U.S. Pat. No. 5,097,513 to Jordan et al.

OBJECTS AND SUMMARY OF THE INVENTION

Accordingly, it is an object of the present invention to provide a portable sound speaker system and driving circuit therefor that overcomes the problems with the aforementioned prior art.

It is another object of the present invention to provide a portable sound speaker system and driving circuit therefor that produces an acoustic field throughout a room that imparts an extra dimension to the sound quality.

It is still another object of the present invention to provide a portable sound speaker system and driving circuit therefor in which the level of the sound signal is substantially uniform in an entire room, that is, in which the sound level falls off at a much slower rate than with conventional speaker systems.

It is yet another object of the present invention to provide a portable sound speaker system and driving circuit therefor in which the speaker is properly loaded from the front and rear thereof.

It is a further object of the present invention to provide a portable sound speaker system and driving circuit therefor in which there is little cancellation of the back wave and front wave from the speaker system.

It is a still further object of the present invention to provide a portable sound speaker system and driving circuit therefor in which the power of the back wave is used, rather than being thrown away.

It is a yet further object of the present invention to provide a portable sound speaker system and driving circuit therefor having substantially no resonance.

It is another object of the present invention to provide a portable sound speaker system and driving circuit therefor in which the power of the signal supplied for driving the speaker has its level adjusted in response to detection of current supplied to the speaker.

It is still another object of the present invention to provide a portable sound speaker system and driving circuit therefor which provides a gain to the signal supplied to the speaker for low frequency sound waves.

In accordance with an aspect of the present invention, a speaker system includes a vertically oriented elongated tube supported on a ground surface and having an axial direction, the tube being open at upper and lower ends thereof; a speaker mounted at a lower end of the vertically oriented elongated tube and having a front driving face with an effective driving area, the speaker providing an in-phase audio signal directed upwardly through the elongated tube and an out-of-phase ground wave audio signal directed in an opposite direction therefrom; an enclosure for at least partially enclosing the speaker; and means for providing resistive loading at a lower portion of the speaker, the means for providing resistive loading including a restricted open area formed by the enclosure adjacent to the ground surface, the restricted open area being less than the effective driving area and being arranged to transmit the out-of-phase ground wave audio signal from the speaker in a direction transverse to the axial direction.

In one embodiment, the enclosure mounts the elongated tube on the ground surface, the enclosure having at least one side wall in at least partially surrounding relation to the speaker and a top wall with an opening therein in alignment with the elongated tube; and the restricted open area is in the at least one side wall of the enclosure adjacent to the ground surface. In such case, the at least one open area includes a plurality of openings provided at a lower portion of the at least one side wall of the enclosure.

In another embodiment, the enclosure mounts the elongated tube on the ground surface, the enclosure having at least one side wall in at least partially surrounding relation to the speaker and a top wall with an opening therein in alignment with the elongated tube; and further including means for supporting the enclosure above the ground surface such that the restricted open area is defined by an area between a lower end of the enclosure and the ground surface.

In still another embodiment, the speaker is mounted within the elongated tube, and the enclosure is formed by a lower end of the elongated tube. In such case, the restricted open area is in the lower end of the elongated tube, or is defined by an area between the lower end the elongated tube and the ground surface.

Preferably, the speaker is a woofer, and there is at least one other speaker mounted at the lower end of the elongated tube, the at least one other speaker providing an in-phase audio signal directed upwardly through the elongated tube. In the preferred embodiment, the at least one other speaker includes at least one of a mid-range speaker and a tweeter. Mounting means is provided for mounting the at least one other speaker at substantially the same vertical level as the first-mentioned speaker so as to avoid delays between different frequency sounds from the different speakers.

Further, at least one diffuser plate is mounted transversely in the elongated tube so as to be coaxial therewith, for preventing formation of standing waves in the elongated tube. Each diffuser plate includes a plate transversely mounted within the elongated tube and having a plurality of small openings therein.

In accordance with another aspect of the present invention, a speaker system includes a vertically oriented elongated tube supported on a ground surface, the tube being open at upper and lower ends thereof; a speaker mounted at a lower end of the vertically oriented elongated tube, the speaker providing an in-phase audio signal directed upwardly through the elongated tube and an out-of-phase ground wave audio signal directed in an opposite direction therefrom, the speaker having an impedance; and a driving circuit for driving the speaker in accordance with an input signal thereto, the driving circuit including a first power amplifier for amplifying the input signal with a variable gain and supplying the amplified input signal to the speaker; means for measuring the impedance of the speaker; and means for varying the gain of the first power amplifier in dependence upon the measured impedance of the speaker.

The means for measuring includes current monitoring means for monitoring a current of the amplified input signal supplied to the speaker; and the means for varying includes gain adjustment means for increasing the gain of the power amplifier primarily for low frequency components of the input signal in response to the monitored current by the current monitoring means. Preferably, the current monitoring means includes a resistor through which the amplified input signal is supplied to the speaker.

The gain adjustment means includes amplifier means for amplifying a signal corresponding to the monitored current with a variable gain and for supplying the amplified signal corresponding to the monitored current to the power amplifier; and frequency selective feedback means for feeding back an output signal of the amplifier means to an input thereof with a level dependent on the frequency of the output signal so as to vary the gain of the amplifier means. Preferably, the frequency selective feedback means includes a parallel circuit of a resistor and a capacitor supplied with the output signal and connected to the input of the frequency selective amplifier means, wherein high frequency components of the output signal pass primarily through the capacitor and low frequency components of the output signal pass primarily through the resistor. In any event, the output signal from the amplifier means of the gain adjustment means is supplied as a positive feedback signal to the power amplifier.

In addition, there is a second power amplifier for amplifying the amplified input signal from the first power amplifier, and the current monitoring means is connected to an output of the second power amplifier.

In accordance with still another aspect of the present invention, a driving circuit for a speaker, includes a first power amplifier for amplifying an input signal with a variable gain and supplying the amplified input signal to the speaker; means for measuring the impedance of the speaker; means for varying the gain of the first power amplifier in dependence upon the measured impedance of the speaker.

In accordance with yet another aspect of the present invention, a speaker system includes a vertically oriented elongated tube supported on a ground surface and having an axial direction, the tube being open at upper and lower ends thereof; a speaker mounted at a lower end of the vertically oriented elongated tube and having a front driving face with an effective driving area, the speaker providing an in-phase audio signal directed upwardly through the elongated tube and an out-of-phase ground wave audio signal directed in an opposite direction therefrom; an enclosure for at least partially enclosing the speaker; means for providing resistive loading at a lower portion of the speaker, the means for providing resistive loading including a restricted open area formed by the enclosure adjacent to the ground surface, the restricted open area being less than the effective driving area and being arranged to transmit the out-of-phase ground wave audio signal from the speaker in a direction transverse to the axial direction; and a driving circuit for driving the speaker in accordance with an input signal thereto, the driving circuit including a first power amplifier for amplifying the input signal with a variable gain and supplying the amplified input signal to the speaker; means for measuring the impedance of the speaker; means for varying the gain of the first power amplifier in dependence upon the measured impedance of the speaker.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
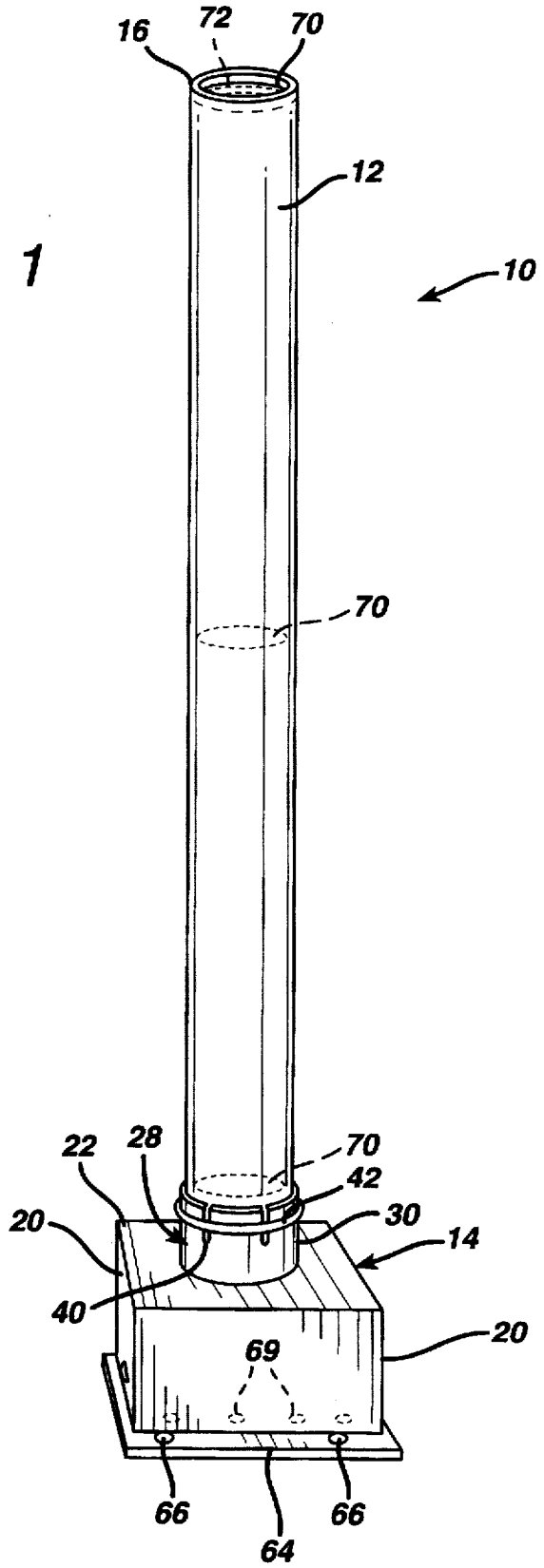
FIG. 1 is a perspective view of a portable sound speaker system according to the present invention.
Figure 2:
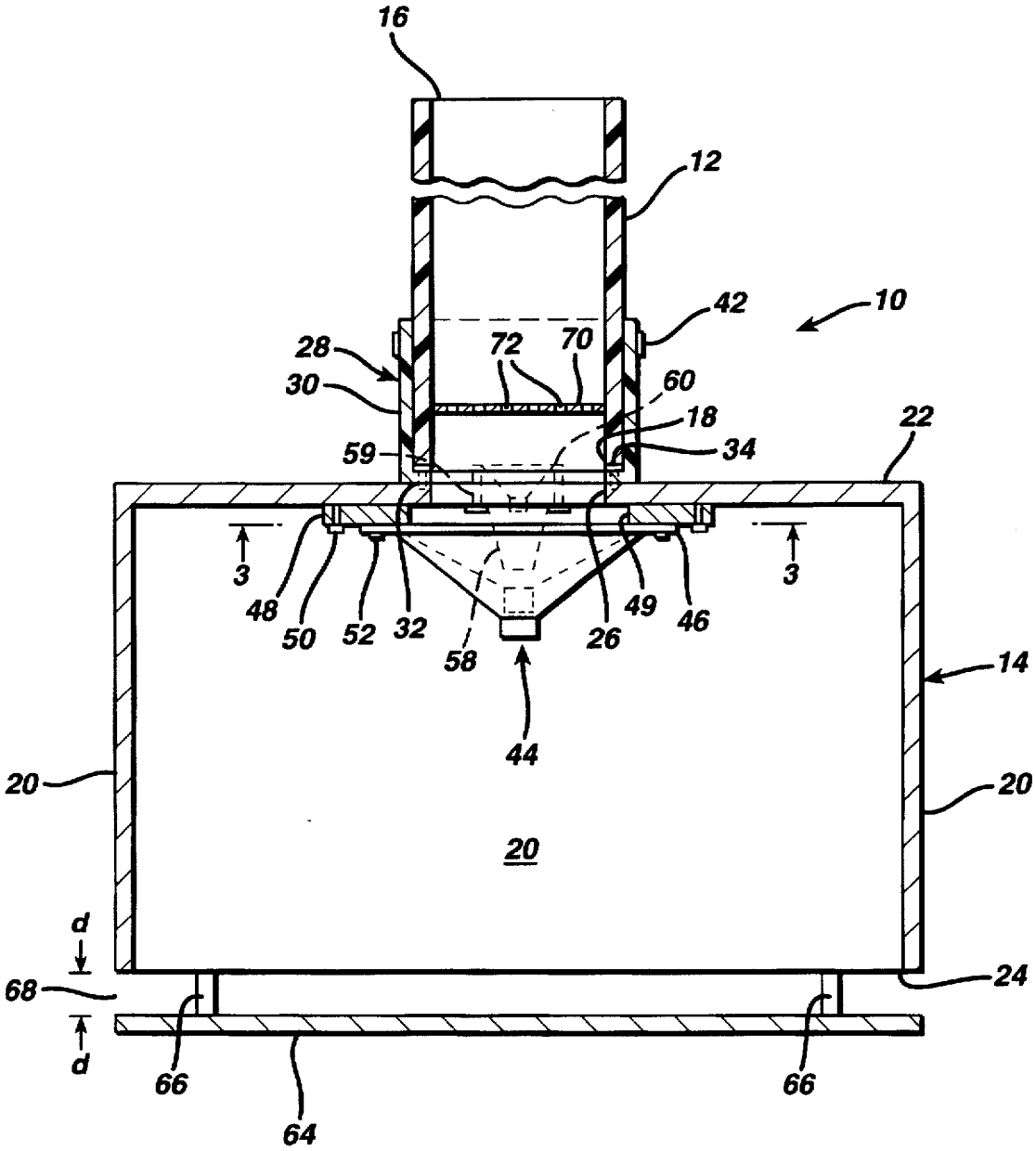
FIG. 2 is an enlarged longitudinal cross-sectional view of the portable sound speaker system of FIG. 1.

Referring to the drawings in detail, and initially to FIGS. 1 and 2, a portable sound speaker system 10 according to the present invention includes an elongated cylindrical tube 12 that is supported in a generally vertical orientation on an open, raised support box 14. Elongated tube 12 is open at opposite ends thereof, that is, at its upper end 16 and lower end 18, and can have any suitable diameter, for example, a six inch outer diameter or the like. Further, elongated tube 12 can have any suitable length, for example, five feet, although it is preferred that the total height of the system be within a range of two to eight feet for normal household use. For example, in large theaters, elongated tube 12 can have much greater lengths. Support box can having any suitable dimensions, such as twelve inches wide by twelve inches long by six inches high.

Support box 14 is shown to have a substantially cubical shape, although the present invention is not limited thereto. As shown, support box 14 includes four side walls 20 and a top wall 22 integrally formed with and connecting upper ends of side walls 20. The lower ends of side walls 20 define the open lower end 24 of support box 14. Further, a circular central opening 26 is provided in top wall 22, with opening 26 being in axial alignment with tube 12. Preferably, the inner diameter of opening 26 is the same as that of tube 12, although this is not essential to the present invention. Thus, it is only necessary that the inner diameter of tube 12 be at least as great as that of opening 26 so that tube 12 will sit upon top wall 22 in surrounding relation to opening 26.

Any suitable means may be used to secure tube 12 to top wall 22. In accordance with one embodiment of the present invention, a cup-like coupling member 28 is provided. Coupling member 28 is formed as a short open cylindrical tube 30 having a lower, inwardly directed annular lip 32 integrally formed at the lower end thereof. The inner diameter of annular lip 32 is preferably the same as the diameter of opening 26 and sits on top wall 22 around opening 26. Bolts 34 extend down through openings in annular lip 32 and are received in corresponding threaded openings in top wall 22, in surrounding relation to opening 26. Accordingly, annular lip 32 is secured to the upper surface of top wall 22 in surrounding relation to opening 26.

It will be appreciated that the outer diameter of elongated tube 12 is similar to the inner diameter of short cylindrical tube 30 so that the lower end of elongated tube 12 fits within short cylindrical tube 30, until the lower edge of elongated tube 12 rests on bolts 34, as shown in FIG. 2. In order to secure elongated tube 12 within short cylindrical tube 30 in such position, a plurality of axially directed slits 40 are formed in spaced circumferential relation around the upper end of short cylindrical tube 30 of coupling member 28, and a strap or band 42 is tightened around the outer circumference of short cylindrical tube 30 at the upper portion thereof so as to compress short cylindrical tube 30 around the lower end of elongated tube 12. Of course, any other suitable means for securing elongated tube 12 to short cylindrical tube 30 can be provided, such as bolts, adhesive or the like.

In this arrangement, elongated tube 12 is mounted on top wall 22 so as to be in axial alignment with opening 26.

A speaker 44 is mounted to the underside of top wall 22 in axial alignment with opening 26 and elongated tube 12. Speaker 44, in a preferred embodiment, is a woofer, such as an eight inch woofer. Thus, as shown, speaker 44 has a generally conical configuration with a mounting flange 46 at the front face thereof which projects in-phase audio signals upwards into tube 12.

In order to so mount speaker 44, a generally rectangular adaptor plate 48 having a circular opening 49 at least as large as the actively moving front face of the speaker cone of speaker 44 so as not to hinder movement thereof, is secured to the underside of top wall 22 in axial alignment with opening 26, by bolts 50 extending through adaptor plate 48 and engaged within threaded openings at the underside of top wall 22. In like manner, bolts 52 extend through openings in mounting flange 46 and are engaged within threaded openings at the underside of adapter plate 48. Thus, speaker 44 is mounted at the lower end of elongated tube 12 and faces upwardly thereof so as to radiate sound upwardly through elongated tube 12.

Of course, it will be appreciated that mounting flange 46 can be connected directly to the underside of top wall 22, while eliminating adaptor plate 48, or alternatively, speaker 44 can be mounted within the lower end of elongated tube 12. However, with the present invention, other speakers are also mounted in portable sound speaker system 10, as will now be described, and therefore, it is preferable to utilize the arrangement of adaptor plate 48.

Figure 3:
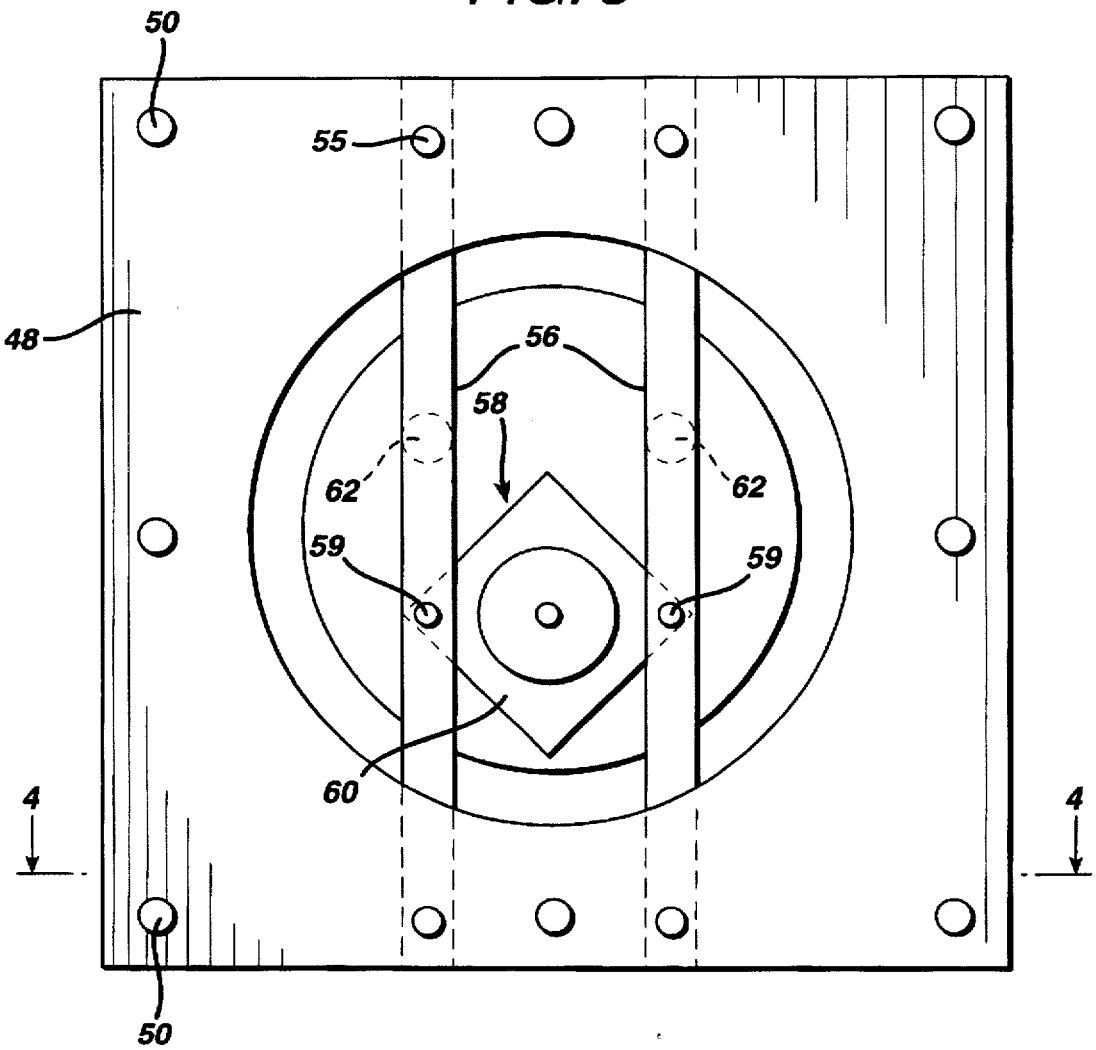
FIG. 3 is a plan view of a portion of the portable sound speaker system of FIG. 2, viewed along line 3—3 thereof.
Figure 4:
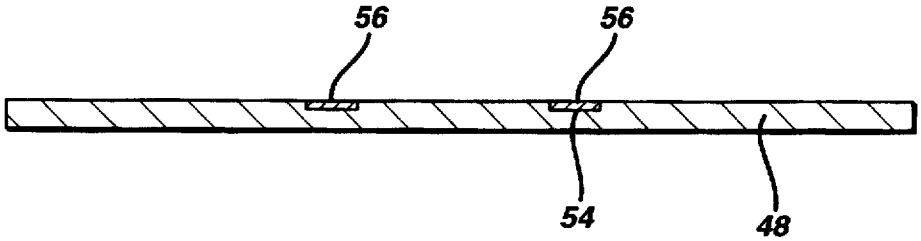
FIG. 4 is a cross-sectional view of the adaptor plate and speaker support bars of FIG. 3, taken along line 4—4 thereof.

Specifically, as shown best in FIGS. 2–4, two spaced apart, parallel grooves 54 are formed in the upper surface of adaptor plate 48, and two thin aluminum speaker support bars 56 are fixed in grooves 54 by bolts 55 or the like, so as to traverse opening 49.

A three inch mid-range speaker 58 is mounted between speaker support bars 56. Specifically, mid-range speaker 58 has a generally frusto-conical configuration with a mounting flange 60 at the front face thereof. Opposite corners of mounting flange 60 are secured above and to upper surfaces of speaker support bars 56 by stand-offs 59 so that mid-range speaker 58 is positioned therebetween.

In addition, two one inch tweeters 62 are mounted directly on top of speaker support bars 56, respectively. Tweeters 60 are of conventional construction, and preferably have a generally cylindrical configuration.

Thus, woofer 44, mid-range speaker 58 and tweeters 62 are all mounted at the lower end of elongated tube 12 and face upwardly thereinto, so as to project sound up through elongated tube 12. It will be appreciated that, although mid-range speaker 58, tweeters 62 and speaker support bars 56 are in partially blocking relation to woofer 44, they do not appreciably affect the sound of woofer 44. Because of the load from the column of air in the tube 12, any sound from the speakers does not dissipate rapidly as with speaker systems where the speaker is mounted at the top of the elongated tube.

It will be appreciated that, with the above arrangement, all of the speakers 44, 58 and 62 are mounted substantially at the same level so that there is no time delay between the different frequency sounds of the different speakers.

In driving woofer 44, it is necessary to provide a resistive loading on the speaker cone for woofer 44, in order for woofer 44 to accurately produce sound in response to the signal input thereto. In order to provide such resistive loading, support box 14 is raised off of the floor or ground surface by a small distance to produce an open area at open lower end 24 thereof. The open area is a transverse area, that is, transverse to the axis of elongated tube 12 so that a low frequency ground wave travels outwardly along the ground surface in all directions. In one embodiment of the present invention, as shown in FIGS. 1 and 2, a base plate 64 rests on the ground and four support posts 66 which are connected between the lower edge of support box 14 and base plate 64, serve to hold support box 14 above base plate 64 with a small gap 68 therebetween.

The resistive load is controlled by the open area at the bottom of support box 14 which is defined as the gap distance d times the peripheral distance around support box 14. For example, if support box 14 has an outer peripheral length of 48 inches and the gap distance d equals 1 inch, the open area is 48 square inches. In accordance with the present invention, it is important that this open area be less than the total circular, planar area at the front driving face of woofer 44. For example, if woofer has a front circular face or driver with a diameter of eight inches, then the area thereof is $\pi^2$=50.24 square inches, which is greater than the bottom open area to provide proper resistive loading for woofer 44. If the bottom open area is greater than the speaker area, proper resistive loading will not be produced, which will result in deterioration of the sound quality. Thus, proper resistive loading in accordance with the present invention will reduce the Q of the system, which will reduce any resonance in the system. Thus, small gap 68 functions to damp speaker system 10 in order to eliminate resonance.

It will be appreciated that there are other ways to achieve this result within the scope of the present invention. For example, support box 14 can be placed directly on the floor or ground, and holes or slots 69 shown in dashed lines in FIG. 1 can be provided in spaced relation around the lower end thereof, with the total area of the holes or slots being less than the area at the front circular face or driver of woofer 44. In such case, the lower end of support box 14 can be closed. Alternatively, support box 14 can be eliminated, and elongated tube 12 can sit directly on the ground surface, with woofer 44 mounted therein, and with transverse holes or slots, similar to holes or slots 69, being provided at the lower end of the elongated tube 12 to the rear of woofer 44. As a still further alternative, support means can be provided for supporting elongated tube 12 such that the lower end thereof is raised off of the ground surface by a distance equal to the small gap 68.

In addition to providing resistive loading, gap 68 results in the generation of a ground wave therethrough. It will be appreciated that, in conventional speaker systems which face forwardly, an enclosure is provided so that the back or ground wave cannot interact with the front wave that is projected forwardly from the speaker. In fact, in many conventional speaker systems, the enclosure is filled with a sound absorbing material, so that approximately one-half of the power of the speaker is thrown away. This, of course, requires additional power to be supplied to obtain a desired sound level.

In the present invention, on the other hand, the back wave is used, that is, the back wave from speaker 44 exits through gap 68 as an omnidirectional, low frequency ground wave which is an out-of-phase audio signal, that is, 180° out of phase with the in-phase signal exiting the top of tube 12. Because speaker system 10 according to the present invention sits on the ground, the back wave or out-of-phase audio signal travels along the ground, and does not travel up elongated tube 12 to cancel with the in-phase audio signal exiting from the upper end of elongated tube 12. By using a small gap 68 for the aforementioned resistive loading, the sound from small gap 68 is further accelerated along the ground, much like a shotgun, thereby further decreasing the possibility that the sound from gap 68 will travel up elongated tube 12 and cancel with the primary sound wave from the upper open end 16 of elongated tube 12.

In other words, the path necessary for cancellation between the back wave at gap 68 and the front wave at upper open end 16 of elongated tube 12 is increased by reason of the back wave traveling along the ground. As a result, the ground wave does not rise off of the ground until it is much further away from speaker system 10, and thereby provides better impedance matching in the room in which speaker system 10 is situated, and also reduces the power necessary to drive the system.

With such an arrangement, the back wave will produce sounds as far below the audible hearing range. Although this cannot be heard by the human ear, the vibrations can be felt which add to the feeling obtained by the listener. This is particularly important when the system is used to reproduce surround sound signals.

As discussed above, there are four speakers 44, 58 and 62 that are preferably used with the present invention, even though the present invention will operate with only one speaker. Due to the use of multiple speakers, however, standing waves may be produced in elongated tube 12, which is undesirable. In order to eliminate the standing waves, at least one diffuser screen 70 is transversely mounted in elongated tube 12. Preferably, there are three diffuser screens 70, as shown in FIG. 1, that is, a first one immediately above coupling member 28, a second one at the upper end of elongated tube 12, and a third one substantially mid-way between the first and second diffuser screens 70. The third or middle diffuser screen 70 may be eliminated. As shown in FIG. 1, for example, each diffuser screen 70 can be a perforated metal plate having a plurality of holes 72 therein. For example, holes 72 can be arranged in alternating rows of ⅛ inch and 1/16 inch diameter holes, although any other suitable arrangement can be provided for breaking up the standing waves.

Diffuser screens 70 prevent resonance by breaking up elongated tube 12 into smaller sections, which is the equivalent of several smaller tubes connected together.

With the arrangement thus far described, sound waves are produced at upper open end 16 of elongated tube 12, and produce an omnidirectional acoustic field in the entire room, in which the acoustic power drops off at a much lower rate than with conventional speaker systems. Specifically, in the primary direction of conventional front facing speaker systems, there is a greater acoustic power drop-off over distance in comparison with the present invention, and this power drop-off is even greater at angles deviating from the primary direction thereof. This difference in power drop off is due to the point source nature of conventional speaker systems versus the omnidirectional transverse acoustic field produced with the present invention.

With conventional speaker systems, the power drop off is particularly noticeable for high and low frequency sounds, which drop off at a much faster rate than mid-range sounds. With the present invention, the drop off is substantially the same for all frequency sounds, and therefore, there is very little drop off for the entire range of the audio signal.

In addition, it is noted that the present invention will operate with the same effectiveness outside where there are no ceilings and walls for the sound to reflect from. In such case, the same omnidirectional acoustic field is produced. The effect of drop-off for high and low frequency sounds is even more pronounced outside for conventional speaker systems. However, use of the present invention inside and outside is substantially the same, with very little drop-off at all frequencies.

Figure 5A:
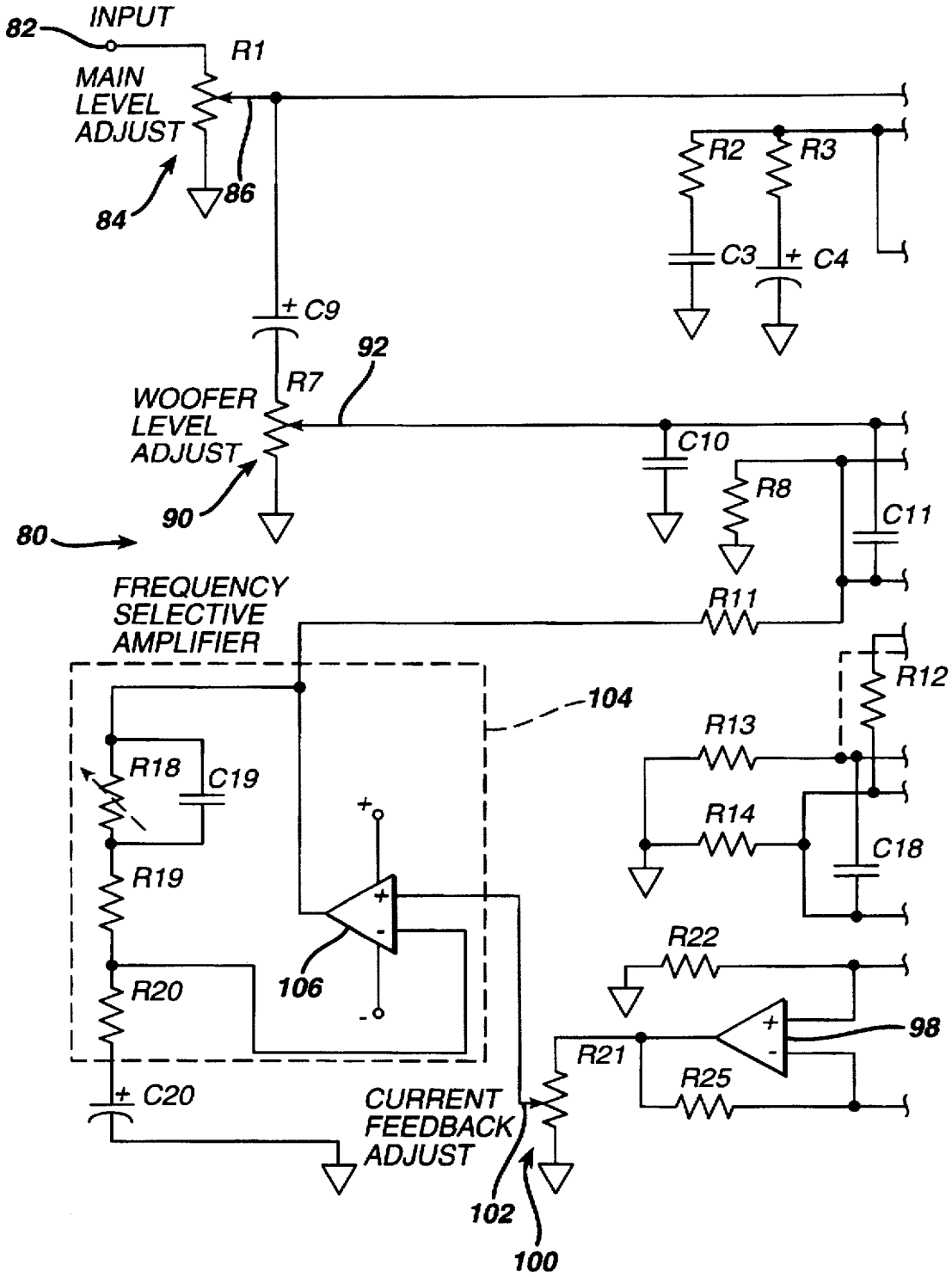
FIG. 5 is a circuit diagram of the driving circuit for the portable sound speaker system of FIG. 1.
Figure 5B:
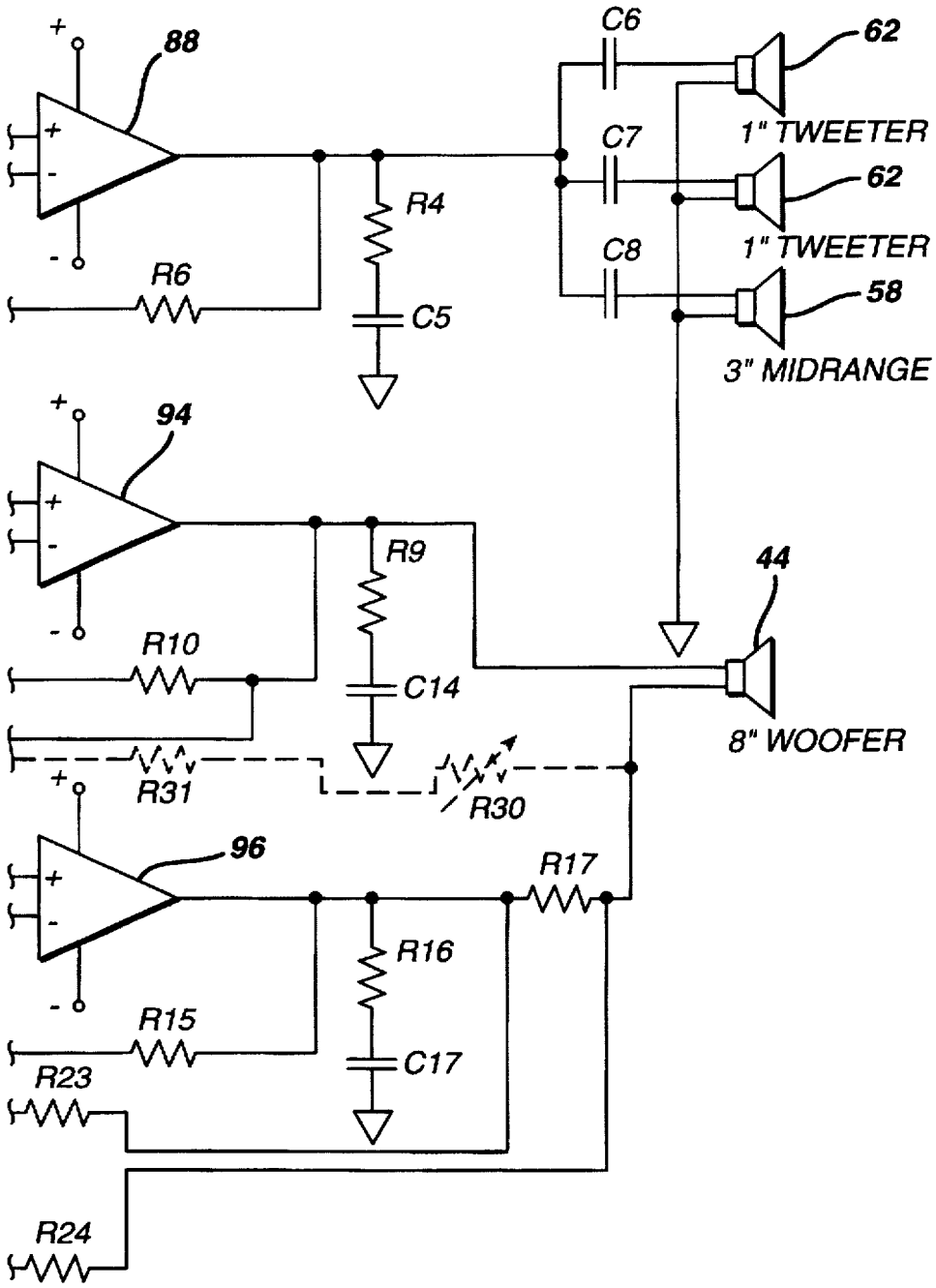

Referring now to FIG. 5, there is shown a circuit diagram of the driving circuit 80 for speaker system 10.

As shown therein, an input electrical signal corresponding to the audio signal to be reproduced by speaker system 10 is supplied to an input 82 and through a main level adjust circuit 84 where the level of the entire signal is adjusted. Main level adjust circuit 84 is factory preset, and includes a potentiometer comprised of a resistor R1 connected between input 82 and ground, and a movable arm 86 which can tap resistor R1 at any point thereon.

The signal from movable arm 86 is first supplied to the non-inverting or positive input of a power amplifier 88 for mid-range speaker 58 and tweeters 62. As shown, power amplifier 88 has its output fed back to the inverting or negative input thereof through a resistor R6 to stabilize the signal. In addition, the inverting input of power amplifier 88 is connected to ground through a series circuit of a resistor R2 and capacitor C3 and also through a series circuit of a resistor R3 and a capacitor C4. The series circuit of resistor R2 and capacitor C3 functions to boost the high frequency signal for tweeters 62 to amplifier 88, while the series circuit of resistor R3 and capacitor C4 functions to block low frequency components of the signal supplied to amplifier 88, for example, below 200 Hz.

Figure 7:
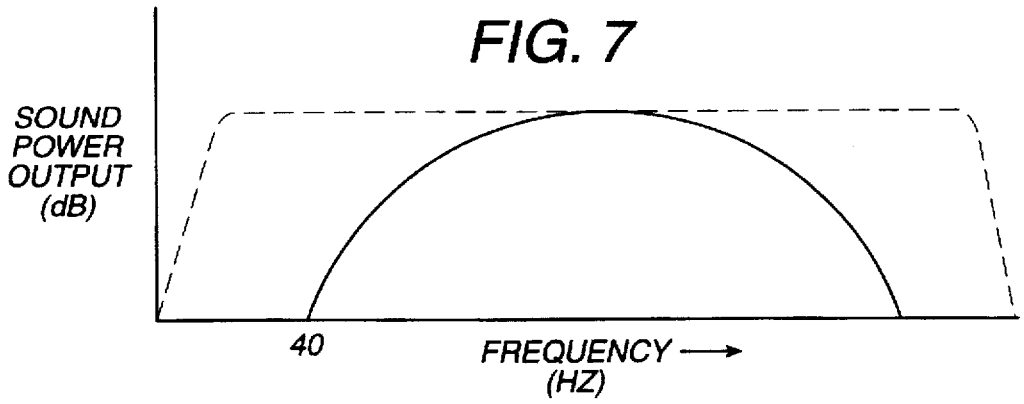
FIG. 7 is graphical diagram of the output power versus frequency for a woofer.
Figure 8:
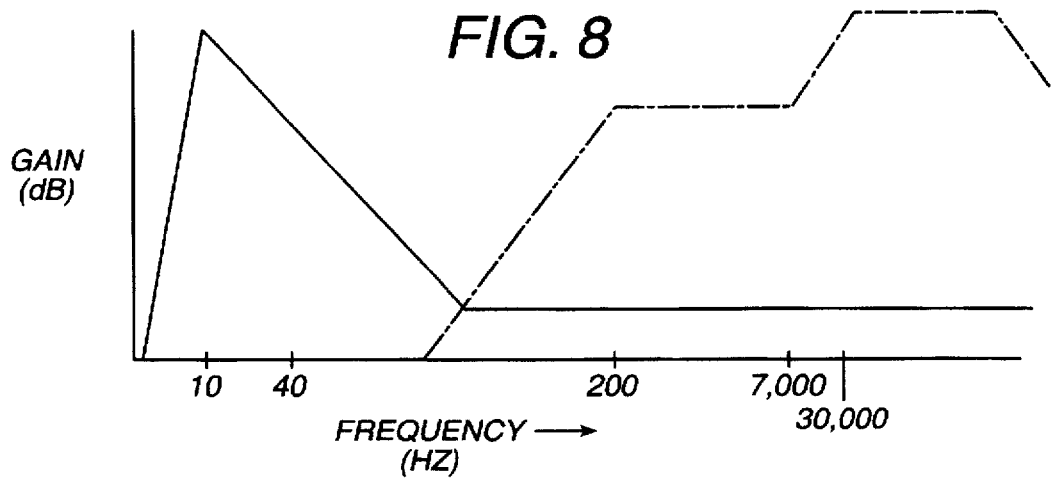
FIG. 8 is a graphical diagram of the gain resulting from the current feedback loop according to the present invention versus frequency.

Due to the aforementioned components, the gain of power amplifier 88 versus frequency is shown by the dot-dash chain line of FIG. 8. As a result, the sound power output at high frequencies is extended as shown by the dashed line in FIG. 7.

The output of power amplifier 88 is connected to one terminal of each of tweeters 62 and mid-range speaker 58 through respective capacitors C6, C7 and C8 for driving the same, while the other terminals of such speakers 58 and 62 are connected to ground. Capacitors C6–C8 function to shape the frequency response of the mid-range speaker 58 and tweeters 62. In addition, the output of power amplifier 88 is connected to ground through a series circuit of a resistor R4 and a capacitor C5, to roll-off the gain of amplifier 88 above the audio range, to prevent oscillation of amplifier 88.

Accordingly, mid-range speaker 58 and tweeters 62 are caused to project sound upwardly through elongated tube 12.

The signal from movable arm 86 is also supplied to a special woofer level adjust circuit 90 for adjusting the level of the signal to be supplied to woofer 44. Woofer level adjust circuit 90 is factory preset, and includes a potentiometer comprised of a resistor R7 connected between movable arm 86 and ground, and a movable arm 92 which can tap resistor R7 at any point thereon.

The level adjusted signal from woofer level adjust circuit 90 is supplied to the non-inverting or positive input of a power amplifier 94 for woofer 44. As shown, power amplifier 94 has its output fed back to the inverting or negative input thereof through a resistor R10. In addition, the inverting input of power amplifier 94 is connected to ground through a resistor R8. Resistors R8 and R10 set the gain for amplifier 94 by providing negative voltage feedback in order to reduce distortion and stabilize the signal. Capacitors C10 and C11, along with the series circuit of resistor R9 and capacitor C14, function to roll-off the gain of amplifier 94 above the audio range, to prevent oscillation of amplifier 94.

The output of power amplifier 94 is connected to one terminal of woofer 44 for driving the same.

In accordance with the present invention, the output from power amplifier 94 is also supplied to the inverting or negative input of another power amplifier 96 of the woofer driving circuit through a resistor R12. As shown, power amplifier 96 has its output fed back to the inverting or negative input thereof through a resistor R15. In addition, the inverting input of power amplifier 96 is connected to ground through a resistor R14, and the non-inverting input thereof is connected to ground through a resistor R13. Resistors R14 and R15 set the gain for amplifier 96 by providing negative voltage feedback in order to reduce distortion and stabilize the signal. Capacitor C18, along with the series circuit of resistor R16 and capacitor C17, function to roll-off the gain of amplifier 96 above the audio range, to prevent oscillation of amplifier 96.

The output of power amplifier 96 is connected to the other terminal of woofer 44 for driving the same.

Thus, woofer 44 is driven in a bridged amplifier configuration by power amplifiers 94 and 96 to provide greater power and voltage swing to woofer 44.

Figure 6:
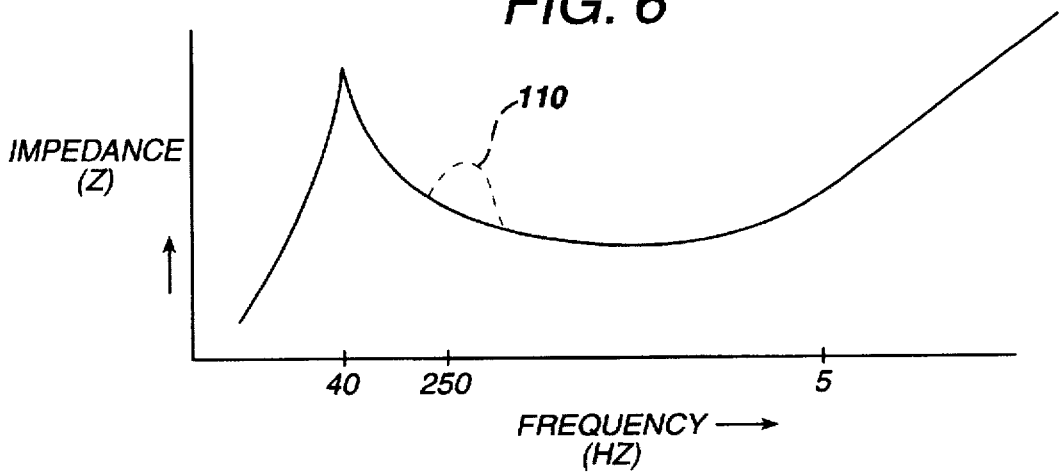
FIG. 6 is graphical diagram of resistance of a woofer versus frequency.

As shown by the solid line in FIG. 6, the impedance of woofer 44, elongated tube 12 and enclosure 14 varies with frequency, as with any conventional speaker system. In the present case, elongated tube 12 provides a column of air which acts as the load for the front face of woofer 44, while enclosure 14 provides the load for the rear of woofer 44.

As shown, the impedance is lowest at the mid-range frequencies so that very little power is needed to drive speaker system 10. However, as the frequency of the resultant sound moves toward the low frequencies, the impedance increases, peaking in the range of approximately 20 Hz to 100 Hz, for example, at approximately 40 Hz, due to the mechanical resonance of woofer 44. Therefore, as shown by the solid line in FIG. 7, the sound power output by speaker system 10 drops dramatically at this resonant frequency.

Conventional speaker systems have attempted to obtain lower frequency sounds below the resonant frequency. This is generally accomplished by carefully tuning a totally enclosed speaker enclosure to provide additional resonances below this frequency, or by a tuned port on a bass reflex cabinet. This provides undesired resonances which further deteriorate the sound by providing muddy and indistinct bass sounds.

In accordance with the present invention, the gain of power amplifier 94 is controlled in accordance with the impedance of woofer 44, elongated tube 12 and enclosure 14. Thus, unlike conventional speaker systems which are driven by an amplified signal having no relation to the speaker impedance, the amplification in the present invention is directly tied to such impedance, and compensates therefor. Thus, where the impedance of woofer 44 is high, for example, at the aforementioned resonant frequency, the circuitry adjusts the power levels to provide a constant acoustic power level for all frequencies.

Thus, the current level supplied to woofer 44 is monitored, and thereby adjusted in a positive feedback circuit. Since the voltage of the signal is known, the current level of the signal supplied to woofer 44 is detected whereby the voltage to current ratio corresponds to the impedance of woofer 44, elongated tube 12 and enclosure 14. Specifically, a resistor R17 constituting a current monitoring circuit is connected between the output of power amplifier 96 and the other terminal of woofer 44, in order to monitor such current. The monitored or detected current across resistor R17 is then supplied to a differential amplifier 98 which produces a voltage corresponding to the current across resistor R17.

In particular, the junction of resistor R17 with the output of power amplifier 96 is supplied to the non-inverting input of differential amplifier 98 through a resistor R23, which is also connected to ground through a resistor R22. The opposite end of resistor R17 is supplied to the inverting input of differential amplifier 98 through a resistor R24. The output of differential amplifier 98 is fed back to the inverting input thereof through a resistor R25. Resistors R22 and R23 set the gain for the positive input to amplifier 98, while resistors R24 and R25 set the gain for the negative input to amplifier 98, with resistors R22, R23, R24 and R25 being carefully matched.

The output of differential amplifier 98 is then supplied to a current feedback adjust circuit 100 which includes a potentiometer comprised of a resistor R21 connected between the output of differential amplifier 98 and ground, and a movable output arm 102 which can tap resistor R21 at any point thereon. Generally, current feedback adjust circuit 100 is set at the factory for the particular speaker system 10 so as to prevent oscillation which could occur if the loop gain is too high, in view of the fact that positive feedback is used. Specifically, in practice, the value of potentiometer 100 is increased until oscillation occurs, thereby confirming that positive feedback is being used, and then, arm 102 is moved to reduce the value of potentiometer 100 slightly to eliminate such oscillation.

The signal from current feedback adjust circuit 100, and particularly, movable arm 102 thereof, is then supplied to the non-inverting input of an amplifier 106 of a frequency selective amplifier 104. The output from amplifier 106 is supplied to a parallel circuit of a resistor R18 and a capacitor C19.

The output of the parallel circuit is supplied through a resistor R19 to the inverting input of amplifier 106, and also to ground through a resistor R20 and capacitor C20.

In this regard, capacitor C19 acts as a short circuit at mid and high frequencies, so that the signal is passed directly through resistor R19 to the inverting input of amplifier 106. Therefore, resistor R19 is effectively taken out of the circuit, so that the gain of the signal supplied to the inverting input of amplifier 106 is determined only by resistors R19 and R20. As a result, the gain of the entire system is effectively unchanged, so that very little feedback control is applied thereto, as indicated by the curve of FIG. 8.

On the other hand, for low frequency signals, capacitor C19 blocks the signal therethrough, so that the gain of amplifier 106 is adjusted by resistors R18, R19 and R20. The values of resistors R18, R19 and R20 are selected so that a maximum gain is applied at a frequency below the aforementioned woofer resonant frequency, for example, at 10 Hz. In effect, this functions to increase the acoustic power output for the system for frequencies below the aforementioned resonant frequency, as shown by the dashed line in FIG. 7. The end result is similar to that of the aforementioned bass reflex system, but without the disadvantage of creating additional resonances.

In a preferred embodiment, resistor R18 may have a resistance value which is four times or more that of resistor R19. For very low frequencies, that is, corresponding effectively to direct current (DC), capacitor C20 causes the gain of FIG. 8 to reduce to one, as shown by that portion of the curve below 10 Hz.

The output signal of amplifier 106 is supplied to the inverting input of power amplifier 94. As a result, when a low frequency signal is present, the current is monitored, and then increased to boost the power to woofer 44. When mid and high frequency signals are present, a constant low gain is applied to amplifier 94, so that the input signal is substantially not affected. Accordingly, driving circuit 80 functions as a power regulation circuit for speaker system 10.

It will be appreciated that there is some gain at mid and high frequencies, as indicated by the horizontal portion of the solid line curve of FIG. 8. This is a result of resistor R19 in the driving circuit 80 of FIG. 5. In order to provide no gain at mid and high frequencies, however, it is only necessary to eliminate resistor R19. Thus, no gain will be applied for signals with frequencies more than 100 to 200 Hz.

In such case, a potentiometer, shown by dashed lines in FIG. 5, can be used in place of resistor R18. Thus, the gain of the circuit at low frequencies can be adjusted.

In the event that mid-range speaker 58 is eliminated so that woofer 44 is used to reproduce the mid-range frequency signals, driving circuit 80 is modified slightly. Specifically, in such case, a series circuit of a variable resistor R30 and a fixed value resistor R31, shown in dashed lines in FIG. 5, is connected between the second terminal of woofer 44 and the positive terminal of power amplifier 96. Further, in such case, resistor R19 is eliminated.

With such modified circuit, it is more difficult for woofer 44 to reproduce mid-range and high frequency sounds. Thus, the series circuit of resistors R30 and R31 will feed back a signal to the positive input of power amplifier 96 which will thereby increase the power supplied to woofer 44. It will be appreciated that this increase in power will operate for all of the low frequency signals, mid-range signals and high frequency signals, for example, as high as approximately 20 KHz.

However, the aforementioned positive feedback circuit which produces positive feedback to the inverting input of power amplifier 94, will then separately adjust the gain only for the low frequency component of the signal. In such case, since resistor R19 is eliminated, no additional gain will be provided for the mid-range and high frequency signals, but rather, the only gain that will be applied will be for the low frequency signals. It will be appreciated that, since some gain is applied as a result of the series circuit of resistors R30 and R31, this will result in some increase in the current across current monitoring resistor R17, so that the gain that is applied to the negative input of power amplifier 94 need not be as high.

Accordingly, with the modified embodiment of the present invention, it is possible to produce a full frequency signal with woofer 44 alone, and thereby eliminate mid-range speaker 58 and tweeters 62.

It will be appreciated that the driving circuit 80 of FIG. 5 is particularly adapted to the arrangement of the speaker system of FIGS. 1–4, although it can be used with any conventional speaker system.

Further, in addition to compensating for low frequency signals, driving circuit 80 also functions to prevent resonance in the system. For example, assume that a standing wave is produced in elongated tube 12 at a frequency in the range of 200 Hz to 300 Hz, which is within the operating range of woofer 44. Such standing wave results in an increased impedance of the system, as shown by curve 110 in FIG. 6 which corresponds to such standing wave.

In such case, because of the increased impedance, the current across current monitoring resistor R17 drops, and due to the feedback to power amplifier 94, the power to woofer 44 will be boosted to eliminate such standing wave, and thereby return the curve of FIG. 6 to the solid line curve portion thereof.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A speaker system comprising:

a vertically oriented elongated tube supported on a ground surface and having an axial direction, said tube being open at upper and lower ends thereof;

a first speaker mounted at a lower end of said vertically oriented elongated tube such that said first speaker is positioned substantially closer to the ground surface than to the upper end of said tube when said tube is supported vertically on the ground surface, said first speaker having a front driving face with an effective driving area and a rear face, said first speaker providing an in-phase audio signal directed upwardly through said elongated tube and an out-of-phase ground wave audio signal directed in an opposite direction therefrom; and an arrangement for providing resistive loading at a lower portion to a rear of said first speaker when said tube is supported vertically on the ground surface, said arrangement comprising a restricted open area formed between said rear face of said speaker and the ground surface when said tube is supported vertically on the ground surface, said restricted open area being less than said effective driving area and being arranged to transmit said out-of-phase ground wave audio signal from said first speaker in a direction substantially at right angles to said axial direction, and the restricted open area is open when the speaker system is mounted on a flat surface with a vertical orientation, the restricted open area extending in a direction substantially at right angles to said axial direction.

2. A speaker system according claim 1, further comprising an enclosure for at least partially enclosing said first speaker; and wherein:

said enclosure mounts said elongated tube on the ground surface, said enclosure having at least one side wall in at least partially surrounding relation to said first speaker and a top wall with an opening therein in alignment with said elongated tube; and said restricted open area is in said at least one side wall of said enclosure adjacent to said ground surface.

3. A speaker system according to claim 2, wherein said restricted open area includes a plurality of openings provided at a lower portion of the at least one side wall of said enclosure.

4. A speaker system according to claim 1, further comprising an enclosure for at least partially enclosing said first speaker; and wherein said enclosure mounts said elongated tube on the ground surface, said enclosure having at least one side wall in at least partially surrounding relation to said first speaker and a top wall with an opening therein in alignment with said elongated tube; and further comprising an assembly for supporting said enclosure above the ground surface such that said restricted open area is defined by an area between a lower end of said enclosure and the ground surface.

5. A speaker system according to claim 2, wherein said first speaker is mounted within said elongated tube, and said enclosure is formed by a lower end of said elongated tube.

6. A speaker system according to claim 5, wherein said restricted open area is in said lower end of said elongated tube.

7. A speaker system according to claim 5, wherein said restricted open area is defined by an area between said lower end of said elongated tube and the ground surface.

8. A speaker system comprising:

a vertically oriented elongated tube supported on a ground surface and having an axial direction, said tube being open at upper and lower ends thereof;

a first speaker mounted at a lower end of said vertically oriented elongated tube such that said first speaker is positioned substantially closer to the ground surface than to the upper end of said tube when said tube is supported vertically on the ground surface, said first speaker having a front driving face with an effective driving area and a rear face, said first speaker providing an in-phase audio signal directed upwardly through said elongated tube and an out-of-phase ground wave audio signal directed in an opposite direction therefrom, said first speaker being a woofer;

a second speaker mounted at said lower end of said elongated tube such that said second speaker is positioned substantially closer to the ground surface than to the upper end of said tube when said tube is supported vertically on the ground surface, said second speaker providing an in-phase audio signal directed upwardly through said elongated tube, said second speaker being a tweeter;

a mounting assembly for mounting said second speaker at substantially a same vertical level as the first speaker so as to avoid delays between different frequency sounds from the first and second speakers; and an arrangement for providing resistive loading at a lower portion to a rear of said first speaker when said tube is supported vertically on the ground surface, said arrangement comprising a restricted open area formed between said rear face of said first speaker and the ground surface when said tube is supported vertically on the ground surface, said restricted open area being less than said effective driving area and being arranged to transmit said out-of-phase ground wave audio signal from said first speaker in a direction substantially at right angles to said axial direction.

9. A speaker system according to claim 1, further comprising at least one diffuser plate, mounted substantially at right angles to said axial direction in said elongated tube so as to be coaxial therewith, for preventing formation of standing waves in said elongated tube.

10. A speaker system according to claim 9, wherein each said diffuser plate includes a plate mounted substantially at right angles to said axial direction within said elongated tube and having a plurality of small openings therein.

11. A speaker system comprising:

a vertically oriented elongated tube supported on a ground surface, said tube being open at upper and lower ends thereof;

a speaker mounted at a lower end of said vertically oriented elongated tube such that said first speaker is positioned substantially closer to the ground surface than to the upper end of said tube when said tube is supported vertically on the ground surface, said speaker providing an in-phase audio signal directed upwardly through said elongated tube and an out-of-phase ground wave audio signal directed in an opposite direction therefrom, said speaker having an impedance;

a driving circuit for driving said speaker in accordance with an input signal thereto, said driving circuit including:

a first power amplifier for amplifying said input signal with a variable gain and supplying a first amplified input signal to a first input of said speaker;

a circuit for measuring the impedance of said speaker;

a gain varying circuit for varying the gain of said first power amplifier in dependence upon the measured impedance of said speaker; and a second power amplifier for amplifying the amplified input signal from said first power amplifier and for supplying a second amplified signal to a second input of said speaker out of phase with the first amplified input signal, said circuit for measuring connected to an output of said second power amplifier; and a resistive feedback circuit connected only between one terminal of said speaker and an input of said second power amplifier for varying the gain of said second power amplifier in dependence upon the measured impedance of said speaker for all frequency components of said input signal and being unconnected with said first power amplifier.

12. A speaker system according to claim 11, wherein said current monitoring circuit includes a resistor through which said amplified input signal is supplied to said speaker.

13. A speaker system comprising:

a vertically oriented elongated tube supported on a ground surface, said tube being open at upper and lower ends thereof;

a speaker mounted at a lower end of said vertically oriented elongated tube, said speaker providing an in-phase audio signal directed upwardly through said elongated tube and an out-of-phase ground wave audio signal directed in an opposite direction therefrom, said speaker having an impedance; and a driving circuit for driving said speaker in accordance with an input signal thereto, said driving circuit including:

a first power amplifier for amplifying said input signal with a variable gain and supplying an amplified input signal to said speaker;

an impedance measuring circuit for measuring the impedance of said speaker, said impedance measuring circuit including a current monitoring circuit for monitoring a current supplied to said speaker; and a gain varying circuit for varying the gain of said first power amplifier in dependence upon the measured impedance of said speaker, said gain varying circuit including a gain adjustment circuit for increasing the gain of said first power amplifier primarily for low frequency components of said input signal in response to the monitored current by said current monitoring circuit, and said gain adjustment circuit includes:

an amplifier for amplifying a signal corresponding to said monitored current with a variable gain and for supplying said amplified signal corresponding to said monitored current to the first power amplifier; and a frequency selective feedback circuit for feeding back an output signal of said amplifier to an input thereof with a level dependent on the frequency of said output signal so as to vary the gain of said amplifier, said frequency selective feedback circuit including a parallel circuit of a resistor and a capacitor supplied with said output signal and connected to said input of said amplifier, wherein high frequency components of said output signal pass primarily through said capacitor and low frequency components of said output signal pass primarily through said resistor.

14. A speaker system according to claim 13, wherein said output signal from said amplifier of said gain adjustment circuit is supplied as a positive feedback signal to said first power amplifier.

15. A driving circuit for a speaker, comprising:

a first power amplifier for amplifying an input signal with a variable gain and supplying a first amplified input signal to a first input of said speaker;

a circuit for measuring the impedance of said speaker;

a gain varying circuit for varying the gain of said first power amplifier in dependence upon the measured impedance of said speaker;

a second power amplifier for amplifying the amplified input signal from said first power amplifier and for supplying a second amplified signal to a second input of said speaker out of phase with the first amplified input signal, said circuit for measuring connected to an output of said second power amplifier; and a resistive feedback circuit connected only between one terminal of said speaker and an input of said second power amplifier for varying the gain of said second power amplifier in dependence upon the measured impedance of said speaker for all frequency components of said input signal and being unconnected with said first power amplifier.

16. A driving circuit for a speaker, comprising:

a first power amplifier for amplifying an input signal with a variable gain and supplying an amplified input signal to said speaker;

an impedance measuring circuit for measuring the impedance of said speaker, said impedance measuring circuit including a current monitoring circuit for monitoring a current supplied to said speaker;

a gain varying circuit for varying the gain of said power amplifier in dependence upon the measured impedance of said speaker, said gain varying circuit including a gain adjustment circuit for increasing the gain of said first power amplifier primarily for low frequency components of said input signal in response to the monitored current by said current monitoring circuit, said gain adjustment circuit including:

an amplifier for amplifying a signal corresponding to said monitored current with a variable gain and for supplying said amplified signal corresponding to said monitored current to the first power amplifier; and a frequency selective feedback circuit for feeding back an output signal of said amplifier to an input thereof with a level dependent on the frequency of said output signal so as to vary the gain of said amplifier, said frequency selective feedback circuit including a parallel circuit of a resistor and a capacitor supplied with said output signal and connected to said input of said amplifier, wherein high frequency components of said output signal pass primarily through said capacitor and low frequency components of said output signal pass primarily through said resistor.

17. A driving circuit according to claim 16, wherein said current monitoring circuit includes a resistor through which said amplified input signal is supplied to said speaker.

18. A driving circuit according to claim 16, wherein said output signal from said amplifier of said gain adjustment circuit is supplied as a positive feedback signal to said first power amplifier.

19. A speaker system comprising:

a vertically oriented elongated tube supported on a ground surface and having an axial direction, said tube being open at upper and lower ends thereof;

a first speaker mounted at a lower end of said vertically oriented elongated tube and having a front driving face with an effective driving area, said first speaker providing an in-phase audio signal directed upwardly through said elongated tube and an out-of-phase ground wave audio signal directed in an opposite direction therefrom;

an enclosure for at least partially enclosing said first speaker;

an arrangement for providing resistive loading at a lower portion of said first speaker, said arrangement for providing resistive loading comprising a restricted open area formed by said enclosure adjacent to said ground surface, said restricted open area being less than said effective driving area and being arranged to transmit said out-of-phase ground wave audio signal from said first speaker in a direction substantially at right angles to said axial direction; and a driving circuit for driving said speaker in accordance with an input signal thereto, said driving circuit including:

a first power amplifier for amplifying said input signal with a variable gain and supplying a first amplified input signal to a first input of said speaker;

a circuit for measuring the impedance of said speaker, said impedance measuring circuit including a current monitoring circuit for monitoring a current supplied to said speaker;

a gain varying circuit for varying the gain of said first power amplifier in dependence upon the measured impedance of said speaker, said gain varying circuit including a gain adjustment circuit for increasing the gain of said first power amplifier primarily for low frequency components of said input signal in response to the monitored current by said current monitoring circuit, and said gain adjustment circuit includes:

an amplifier for amplifying a signal corresponding to said monitored current with a variable gain and for supplying said amplified signal corresponding to said monitored current to the first power amplifier;

a frequency selective feedback circuit for feeding back an output signal of said amplifier to an input thereof with a level dependent on the frequency of said output signal so as to vary the gain of said amplifier; and said output signal from said amplifier of said gain adjustment circuit is supplied as a positive feedback signal to said first power amplifier; and a second power amplifier for amplifying the first amplified input signal from said first power amplifier and for supplying a second amplified signal to a second input of said speaker out of phase with the first amplified input signal, said circuit for measuring connected to an output of said second power amplifier.

20. A speaker system according to claim 19, wherein said enclosure mounts said elongated tube on the ground surface, said enclosure having at least one side wall in at least partially surrounding relation to said first speaker and a top wall with an opening therein in alignment with said elongated tube; and said restricted open area is in said at least one side wall of said enclosure adjacent to said ground surface.

21. A speaker system according to claim 19, wherein said enclosure mounts said elongated tube on the ground surface, said enclosure having at least one side wall in at least partially surrounding relation to said speaker and a top wall with an opening therein in alignment with said elongated tube; and further comprising an assembly for supporting said enclosure above the ground surface such that said restricted open area is defined by an area between a lower end of said enclosure and the ground surface.

22. A speaker system according to claim 19, wherein said first speaker is a woofer, and further comprising at least one other speaker mounted at said lower end of said elongated tube, said at least one other speaker providing an in-phase audio signal directed upwardly through said elongated tube.

23. A speaker system according to claim 19, further comprising at least one diffuser plate, mounted substantially at right angles in said elongated tube so as to be coaxial therewith, for preventing formation of standing waves in said elongated tube.

24. A speaker system according to claim 19, wherein said current monitoring circuit includes a resistor through which said current is supplied to said speaker.

25. A speaker system according to claim 1, further comprising at least one device in the tube which breaks up standing waves in the tube to inhibit resonance.

26. A speaker system according to claim 13, further including a second power amplifier for amplifying the amplified input signal from said first power amplifier, and said current monitoring circuit is connected to an output of said second power amplifier.

27. A speaker system according to claim 24, further including a second power amplifier for amplifying the amplified input signal from said first power amplifier, and said current monitoring circuit is connected to an output of said second power amplifier.

* * * * *